United States Patent [19]

Becht

[11] Patent Number: 4,625,903

[45] Date of Patent: Dec. 2, 1986

[54] MULTIPLE IMPACT FASTENER DRIVING TOOL

[75] Inventor: Carl T. Becht, Cincinnati, Ohio

[73] Assignee: Sencorp, Cincinnati, Ohio

[21] Appl. No.: 627,428

[22] Filed: Jul. 3, 1984

[51] Int. Cl.[4] ..... B25C 1/06; B25C 5/15

[52] U.S. Cl. ..... 227/131; 227/147; 173/13; 173/123

[58] Field of Search ..... 227/6, 7, 109, 120, 227/130, 131, 147; 173/13, 117, 122–124

[56] References Cited

U.S. PATENT DOCUMENTS

| | | | |
|---|---|---|---|
| 1,860,826 | 5/1932 | Tschudi | 173/123 |
| 2,002,762 | 5/1935 | Badcon | 173/117 |
| 2,392,233 | 2/1944 | Craig | 125/33 |
| 2,877,820 | 12/1956 | Ristow | 153/21 |
| 2,888,246 | 5/1959 | Sieber | 173/123 |
| 3,015,244 | 1/1962 | Newman | 81/52.3 |
| 3,042,924 | 7/1962 | Frostad | 1/46 |
| 3,280,921 | 10/1966 | Bickford | 173/123 |
| 3,366,302 | 1/1968 | Blicharski | 227/131 |
| 3,602,419 | 8/1971 | Doberne | 227/147 |
| 3,913,685 | 10/1975 | Enstrom | 173/117 |
| 3,924,692 | 12/1975 | Saari | 173/117 |
| 4,511,074 | 4/1985 | Kille et al. | 227/131 X |

FOREIGN PATENT DOCUMENTS

| | | | |
|---|---|---|---|
| 1094908 | 5/1955 | France | 227/120 |

*Primary Examiner*—Robert L. Spruill
*Assistant Examiner*—Taylor J. Ross
*Attorney, Agent, or Firm*—Frost & Jacobs

[57] ABSTRACT

A tool for driving fasteners by means of multiple impact blows. The tool comprises a body with a handle portion and a magazine portion, shiftable in directions parallel to said blows between an extended position substantially outside the body and a retracted position substantially within the body. A prime mover provides a rotating shaft. The rotating shaft is operatively connected to a mechanism for translating rotary motion into reciprocating motion. The translating mechanism comprises a flywheel, an impact member having at least one impacting surface thereon and being attached to or constituting an integral, one-piece part of the flywheel, a free floating energy transfer member separate from but engageable with the impact member, a resilient bumper to arrest the energy transfer member at the termination of its drive cycle, and a fastener driver engageable by or comprising an integral, one-piece part of the energy transfer member. A resilient member normally biases the energy transfer member out of contact with the impact member. When the tool is abutted against a workpiece and pressure is applied by the tool operator, the at least one impacting surface of the impact member transmits blows to the transfer member, causing the transfer member and driver to be forcibly accelerated away from the impact member at a substantial velocity. In this manner, the driver applies short, high velocity drive strokes in a rapid succession to the fastener to be driven.

19 Claims, 4 Drawing Figures

MULTIPLE IMPACT FASTENER DRIVING TOOL

TECHNICAL FIELD

The invention relates to a fastener driving tool, and more particularly to such a tool wherein rotary motion is translated into reciprocating motion in such manner that the tool driver will impart short, high velocity drive strokes in rapid succession to the fastener to be driven.

BACKGROUND ART

Prior art workers have devised many types of fastener driving tools. As used herein and in the claims, the term "fastener" is to be considered in the broadest sense, referring to substantially any fastener capable of being driven into a work piece. Examples of such fasteners are nails, staples and clamp nails of the general type taught, for example, in U.S. Pat. No. 4,058,047.

Perhaps the most common form of fastener driving tool is a pneumatically actuated tool. Prior art workers have developed a multiplicity of pneumatically actuated fastener driving tools to a high degree of safety and sophistication, of which the tool taught in U.S. Pat. No. 3,964,659 is exemplary.

More recently, there has been considerable interest in electro-mechanical fastener driving tools utilizing a solenoid mechanism or a flywheel mechanism to drive the fasteners. Electro-mechanical fastener driving tools are of particular interest for home use and industrial use where a source of compressed air is not available. An example of such a tool is set forth in U.S. Pat. No. 4,298,072.

The fastener driving tools thus far described are of the single blow variety, wherein the fastener is driven home by a single impact of the tool driver. Such tools are well adapted for industrial use, but they tend to be large, bulky and heavy and, therefore, are not as well suited for home use or the like. Such high powered, single blow tools, if misused, are capable of firing a fastener a considerable distance with substantial force. Furthermore, they tend to be noisy, complex in structure and expensive to manufacture.

As a result of the above, prior art workers, with an eye to light industrial applications and home uses, have also turned their attention to multiple impact fastener driving tools wherein simple rotary motion, obtained from an appropriate prime mover, is converted to linear reciprocating motion of a driving piece. Such tools have a number of advantages. First of all, they can employ a low power prime mover. As a result of the reduced power that must be dissipated, as compared to single blow tools, the multiple blow tools are characterized by reduced sound levels. Additionally, they are inherently safer than the single blow tools, since they are incapable of inadvertently firing a fastener over a considerable distance with substantial force. Finally, such tools can be of less complex, more compact, and lighter weight construction than the usual single blow tool.

Despite these advantages, applicants are unaware to date of any successful, large scale commercialization of such a multiple impact tool. Essentially, regardless of the type of fastener driving tool, fasteners are driven with a two-part system—force and velocity. It is well known that the higher the velocity, the easier it is to drive a fastener. It is believed that one of the primary difficulties encountered by prior art multiple impact tools was the fact that they did not produce high velocity impacts.

Generally speaking, prior art multiple impact tools have fallen into two basic categories. The first encompasses those tools which accomplish translation of rotary motion to reciprocating motion through the use of some form of eccentric or crankshaft. An example of such a tool is taught in U.S. Pat. No. 3,042,924. The second includes those multiple impact tools which employ some form of cam profile for translation of rotary motion to reciprocating motion. Exemplary tools of this nature are taught in U.S. Pat. No. 3,366,302.

The tools of the prior art which translate rotary motion into reciprocating motion through the use of an eccentric or crankshaft, produce a motion/velocity curve which can best be expressed as a sine wave. Thus, the fastener drive cycle produced by such a tool is initiated with zero velocity of reciprocation; reaches maximum velocity at the mid-point of the drive cycle; and terminates at zero velocity of reciprocation. Those tools employing an eccentric or crankshaft for motion translation accomplish the translation in a very smooth manner, but with a low and diminishing velocity.

Those prior art tools which translate rotary motion into reciprocating motion through the use of some form of cm profile, attempt to address this problem of attaining velocity in one of two ways. One method is to develop a cam profile which maximizes velocity to the point of reversal of the reciprocating motion. While this represents an improvement, once again such a tool produces the zero velocity condition at some point toward the end of its drive cycle. Furthermore, the motion translation achieved is not very smooth because of the need for rapid deceleration to effect the motion reversal. The other method employed by the prior art is to use a form of cam profile to precondition the drive cycle which is performed by some other power source than the rotating member. This additional power source is usually a spring of some type. These devices again represent an improvement over those devices discussed above, but they require an additional power source to perform the drive cycle and they necessitate an abrupt release by the cam of the other power source in order to release the drive power, and this produces high wear on the cam surface.

U.S. Pat. No. 3,015,244 illustrates an interesting approach wherein a tool includes a driver hammer element and an anvil member operated upon by the hammer element. The hammer element is connected to a prime mover drive shaft by means of a rubber-like cylinder. The cylinder is adapted to be placed in torsion to store energy. The rubber-like cylinder elongates when placed in torsion. This characteristic is utilized in causing the hammer element to be intermittently disengaged from and engaged with the anvil member.

The tool of the present invention utilizes rotary motion translated into reciprocating motion and, at the same time, overcomes the velocity problem which has plagued the prior art. The tool employs a prime mover to produce the necessary rotary motion and a driver to drive the fasteners. The translation mechanism employed by the tool comprises a flywheel for storing the rotary energy; an impact member either coupled to the flywheel or constituting an integral, one-piece part thereof and having at least one impacting surface; an energy transfer member which is free floating in the sense that it is not actively coupled to or constantly in engagement with the impact member, although it is engageable with the impact member; and a resilient energy absorber to arrest the energy transfer member at the termination of its drive cycle. The tool driver is engageable by the energy transfer member, or can be an integral, one-piece part thereof. The above recited elements produce relatively short (0.020–0.150 inch), high-velocity driver strokes in rapid succession to drive a fastener. Means are provided to normally bias the energy transfer member out of engagement with the impact member until the tool is pressed against the workpiece into which the fastener is to be driven. This action causes the energy transfer member to shift into the rotating path of the impact member.

The tool of the present invention is characterized by simple construction with a minimum of parts. The rotary energy is transferred to linear motion by impact, thereby producing a high-velocity transfer. The arresting means, which arrests the impact member and brings it to zero velocity to precondition the next cycle, is independent of the rotating elements. The mechanism of the tool of the present invention is not cycle-dependent. In other words, the tools of the prior art produce a drive cycle which is controlled by the rotating element. This is not the case with respect to the tool of the present invention. The drive cycle of the instant tool is dependent upon the force, provided by the operator, which causes the energy transfer member to engage the impacting surface of the impact member. If the operator applies no force during a revolution, no impact occurs, the energy transfer member being out of contact with the impact member. As a result of this, the operator can drive a fastener infinitely slowly, or as fast as he is willing to provide the force to engage the energy transfer member with the impact member. The motion translating mechanism of the tool of the present invention disengages when a fastener has been driven to the desired predetermined depth. Finally, the tool is compact, lightweight and relatively quiet in operation.

DISCLOSURE OF THE INVENTION

According to the invention, there is provided a tool for driving fasteners by means of multiple impact blows applied to each fastener successively by the driver. The tool comprises a body with a handle portion and a magazine portion. The magazine portion is shiftable in directions parallel to the long axis of the driver between an extended position substantially outside the body of the tool and a retracted position substantially within the tool body.

A prime mover provides a rotating shaft which is operatively connected to a mechanism for translating rotary motion into reciprocating motion. The translating mechanism comprises a flywheel, an impact member, an energy transfer member separate from but engagable with the impact member, and a resilient bumper to arrest the energy transfer member at the termination of its drive cycle. The impact member has at least one impacting surface thereon and is operatively connected to the flywheel, or constitutes an integral one-piece part thereof. The fastener driver is engageable by the energy transfer member, or it can constitute an integral, one-piece part thereof.

A resilient member in the form of a rubber-like structure or spring normally biases the energy transfer member out of contact with the impact member. When the tool is abutted against a workpiece and pressure is applied by the operator, this resilient member is overcome and the at least one impacting surface of the impact member transmits blows to the energy transfer member, causing the energy transfer member and driver to be forcibly accelerated away from the impact member at a substantial velocity. This results in the driver applying short, high-velocity drive strokes in rapid succession to the fastener being driven.

In one embodiment of the present invention, the prime mover shaft is operatively connected to a shaft bearing the flywheel and the impact member, these two shafts being coaxial. The flywheel and impact member shaft being perpendicular to the long axis of the energy transfer member and the driver. In another embodiment of the present invention, the prime mover shaft and the flywheel-impact member shaft are coaxial and are coaxial with the long axis of the energy transfer member and the long axis of the driver.

DETAILED DESCRIPTION OF THE INVENTION

Figures 1, 2:
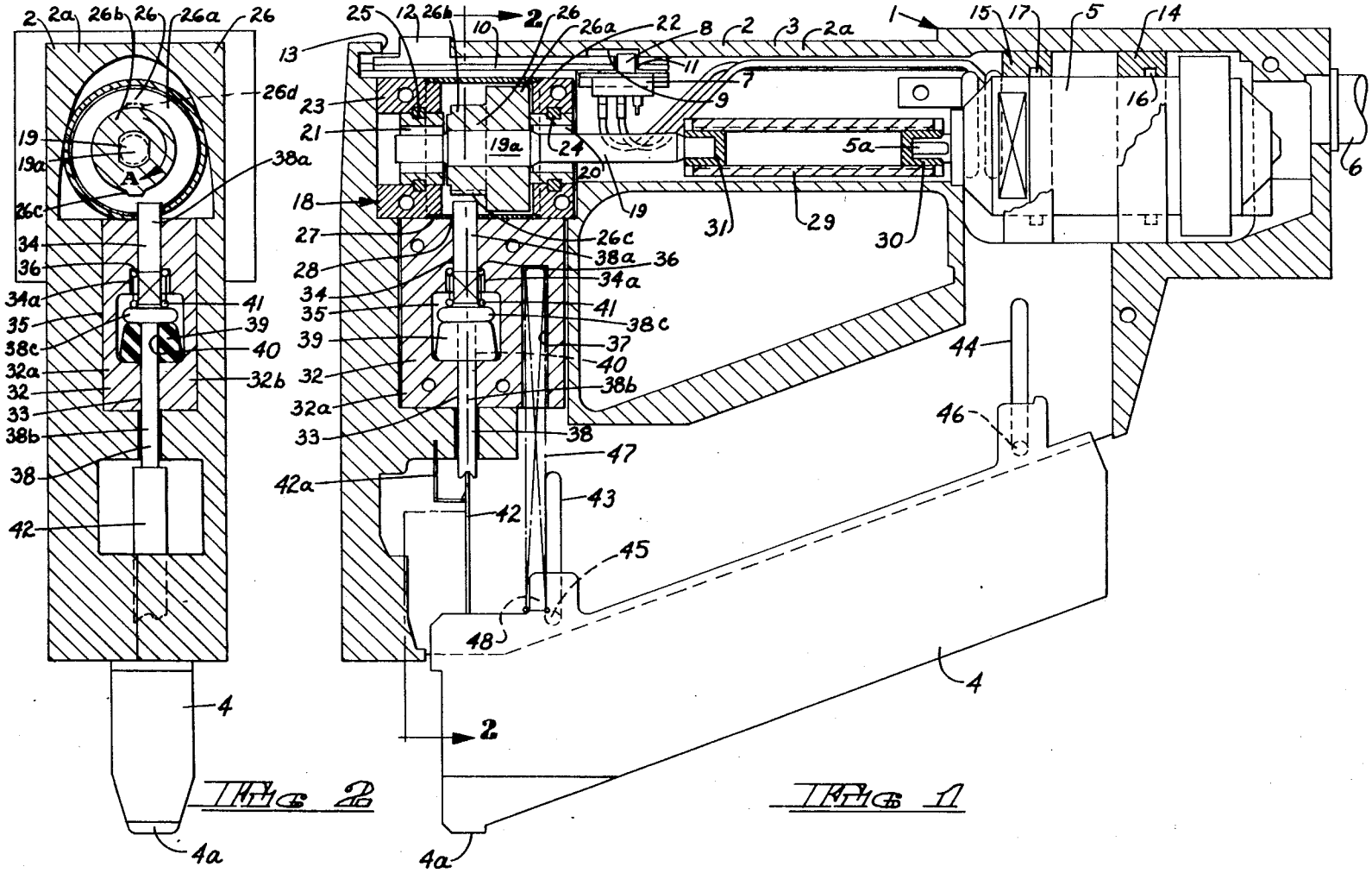
FIG. 1 is an elevational view, partly in cross section, of a first embodiment of the tool of the present invention.
FIG. 2 is a cross-sectional view taken along section line 2—2 of FIG. 1.

A first embodiment of the tool of the present invention is illustrated in FIGS. 1 and 2, and like parts have been given like index numerals. The tool is generally indicated at 1, comprising a body 2 having a handle portion 3. The body 2 supports a magazine 4 provided with a row of fasteners (not shown) and suitable means (not shown), as is well known in the art, to advance each fastener, in its turn, to a forwardmost position to be driven. The body 2 is made up of two halves 2*a* and 2*b* (see FIG. 2). The body halves may be cast of metal or the like. Preferably, however, the body halves are molded of an appropriate plastic material of sufficient strength.

In the embodiment shown, the tool 1 is provided with an AC electric motor 5. It should be understood from the outset that the nature of the prime mover 5 does not constitute a limitation on the present invention. The only limitation is the fact that the prime mover must be capable of supplying simple rotary motion. The prime mover 5 could be, for example, an air motor, an electric motor, an internal combustion engine, a hydraulic motor, or the like. The prime mover could even be remotely located with respect to the tool 1 and a flexible cable could transmit rotary motion to the tool 1.

In the exemplary embodiment illustrated, the electric motor 5 is connectible to a source of household current or the like through a conventional cord set 6 extending through the rearward end of body 2 and containing the usual pair of electrical conductors and a ground wire, if required. The electric motor 5 is controlled by an on-off switch 7. The switch 7 has a conventional actuator 8, shiftable between on and off positions. The body 2 is provided with a relief 9 to accommodate the actuator 8. The actuator 8 of on-off switch 7 is shifted by an elongated slide bar 10. The slide bar 10 has, at its rearward end, a perforation 11 through which the actuator 8 extends. The slide bar 10 is longitudinally shiftable within the body 2 and has at its forward end an upstanding member 12 adapted to be engaged by the thumb or finger of the tool operator. The upstanding member 12 extends through an elongated slot 13 in the top of the tool.

The motor 5 is mounted in body 2 by a pair of motor mounts 14 and 15, which surround the motor 5. The motor mounts 14 and 15 may be provided with resilient members or O-rings 16 and 17, respectively, intended to take up vibration of the motor. The resilient members 16 and 17 are optional. It would also be within the scope of the present invention to have the motor mounts 14 and 15 constitute integral, one-piece parts or ribs molded on the interior of the body halves 2*a* and 2*b*.

At the forward end of the tool 1, there is a flywheel-/impact member subassembly, generally indicated at 18. This subassembly comprises a shaft 19 mounted in bearings 20 and 21. The bearings 20 and 21 are, themselves, mounted in bearing blocks 22 and 23. The bearing blocks 22 and 23 may be made up of two halves, as is well known in the art, and, if desired, may themselves be provided with resilient O-rings 24 and 25, respectively, for vibration damping purposes.

That portion 19*a* of shaft 19 located between bearings 20 and 21 supports a flywheel/impact member assembly 26. In the embodiment illustrated, the flywheel/impact member 26 is shown as having a flywheel portion 26*a* and an impact member portion 26*b* constituting an integral, onepiece structure. The flywheel portion 26*a* is of conventional circular configuration. The impact member portion 26*b* is of circular configuration, but is provided with an impacting surface 26*c*. It will be understood by one skilled in art that the flywheel portion 26*a* and the impact member portion 26*b* could constitute wholly separate structures, separately mounted on shaft portion 19*a*. Alternatively, they could constitute separate portions with the impact member portion 26*b* affixed to the forward face of the flywheel portion 26*a*. The flywheel/impact member 26 is non-rotatively affixed to the portion 19*a* of shaft 19 by any appropriate means well known in the art.

The subassembly 18 is completed by a thin walled, cylindrical member 27 which encloses the flywheel/impact member 26 and joins bearing blocks 22 and 23. The cylindrical member 27 has an opening 28 formed therein, to accommodate the energy transfer member to be described hereinafter.

The rearward end of shaft 19 is operatively affixed to the shaft 5*a* of motor 5. This is accomplished by means of a flexible plastic or rubber-like drive link 29. The flexible drive link 29 is cylindrical or tube-like and is provided at its ends with sockets 30 and 31. The shaft 5*a* of motor 5 is non-rotatively affixed within socket 30, by any appropriate means. Similarly, the rearward end of shaft 19 is non-rotatively affixed within socket 31. The flexible plastic drive link 29 accomplishes a number of purposes. First of all, it transmits the simple rotary motion of motor shaft 5*a* to shaft 19. Secondly, the flexible drive link 27 isolates the motor from the impact vibration of the impact member portion 26*b*. Finally, the flexible drive link electrically isolates the motor from the rest of the drive assembly.

In the forward portion of body 2, beneath subassembly 18, there is mounted a block 32 made up of two halves, 32*a* and 32*b*. when joined together, the block halves 32*a* and 32*b* define a first bore 33, a second coaxial bore 34 and an intermediate chamber 35. That portion of bore 34, adjacent chamber 35, is of slightly enlarged diameter (as at 34*a*) defining a shoulder 36. The block halves 32*a* and 32*b* also define a third bore 37, the purpose of which will be described hereinafter.

An energy transfer member 38 is shiftably mounted within block 32. The energy transfer member 38 is a rodlike structure having an upper portion 38*a*, a lower portion 38*b* and an annular enlarged shoulder 38*c* therebetween. The upper portion 38*a* is slidably mounted in bores 34 and 34*a*, the lower portion 38*b* is slidably mounted in bore 33 and the annular shoulder 38*c* is located within chamber 35. Also located within chamber 35, beneath the annular shoulder 38*c* of energy transfer member 38, there is a resilient, annular bumper 39. The bumper 39 has a bore 40 extending therethrough. The lower portion 38*b* of energy transfer member 38 extends through bore 40 of bumper 39.

The upper portion 38*c* of energy transfer member 38 is surrounded by a compression spring 41. The upper end of compression spring 41 abuts the shoulder 36 in block 32. The lower end of compression spring 41 is seated against the enlarged shoulder 38*c* of energy transfer member 38. As a result of this, and as is clearly shown in FIGS. 1 and 2, the energy transfer member 38 is normally biased by spring 41 out of contact with the impact member portion 26*b* of member 26.

To complete the drive structure, the tool 1 is provided with a driver 42. In some instances, the driver 42 may constitute an integral, one-piece part of energy transfer member 38. On the other hand, the driver 42 can be wholly separate from energy transfer member 38, the upper end of driver 42 being abuttable by the lower end of energy transfer member 38. In such an instance, the driver 42 may constitute a part of the magazine 4, being captively and shiftably mounted therein. FIG. 2 can be considered to illustrate the structure in both its integral and non-integral forms. Means (not shown) may be provided to attach the upper end of driver 42 directly to the lower end of energy transfer member 38. Alternatively, a resilient means may be provided to hold the upper end of driver 42 adjacent the lower end of energy transfer member 38. Such a resilient means is shown in FIG. 1 at 42*a* mounted in body 2 and engaging a detent on driver 42. The lower end of driver 42 (not shown), extending into magazine 4, normally lies above the forwardmost fastener within magazine 4, positioned to drive the forwardmost fastener when the tool 1 is energized.

It will be evident that as a fastener is driven into a workpiece, the tool 1 must approach the workpiece during the fastener driving procedure. This is true because, during the fastener driving operation, the length of the driver remains constant, but the length of that portion of the fastener above the workpiece (into which it is being driven) diminishes as the fastener is driven. In order to permit this, the magazine 4 is shiftable in directions parallel to the driver 42 between an extended position illustrated in FIGS. 1 and 2 and a retracted position (when the fastener has been driven) within the body 2 of tool 1. To permit this, the body halves are provided with opposed forward and rearward guide channels formed in the body halves. The magazine 4 is provided with opposed pairs of peg-like followers engaged within the body half guide channels. In FIG. 1, the forward guide channel in body half 2*a* is shown at 43 and the rearward guide channel in body half 2*a* is shown at 44. The cooperating peg-like followers on magazine 4 are shown at 45 and 46. It will be understood that body half 2b will have guide channels similar to channels 43 and 44 and the magazine 4 will have peg-like followers located therein.

The magazine is biased to its normal extended position (shown in FIGS. 1 and 2) so that it will be in appropriate position at the start of each fastener driving operation. To accomplish this, a compression spring 47 is provided. The upper end of spring 47 is located within and abuts the upper end of the bore 37 of block 32. The lower end of spring 47 surrounds and abuts an upstanding spring seat 48, formed on the upper surface of the magazine 4.

The multiple impact tool of FIGS. 1 and 2 having been described in detail, its operation can be set forth as follows. The tool operator will shift the switch actuator 12 forwardly to its actuated position, turning on-off switch 7 to its on position. This results in the energizing of motor 5 with consequent rotation of motor shaft 5a, flexible link 29, shaft 19 and flywheel/impact member 26 at a relatively high RPM (15,000–30,000 RPM). However, driver 42 is not actuated because the energy transfer member 38 is biased against resilient bumper 39 and out of contact with the impact member 26b.

The tool operator then places the nose portion 4a of magazine 4 against the workpiece into which the fastener is to be driven. The operator then presses the tool toward the workpiece. This results in a shifting of the magazine 4 toward its retracted position within the body 2. The driver 42, contacting the fastener to be driven, is shifted upwardly against the energy transfer member 38. The energy transfer member 38, in turn, is shifted upwardly away from resilient bumper 39 against the action of spring 41, and into the path of the rotating impact member 26b. Flywheel 26a stores the energy from the rotating motor shaft 5a. As the impact member 26b rotates, the impacting surface 26c thereon comes into contact with the upper end of the energy transfer member 38 transmitting an impact to the energy transfer member 38. This results in the energy transfer member being forcibly accelerated away from the impacting surface 26c at a substantial velocity. The energy has now been transferred from the flywheel 26a to the impact member 26b and from the impact member 26b to the energy transfer member 38. Energy from the energy transfer member 38 is imparted to driver 42 and thence to the fastener, so as to drive the fastener into the workpiece. As the fastener is driven into the workpiece, the magazine 4 continues to shift toward its retracted position which is reached when the fastener has been fully driven.

From FIGS. 1 and 2 and the above description, it is obvious that the energy transfer member 38 is free to leave the impacting surface 26c when impacted thereby. Initially, all of the energy in the energy transfer member 38 is transmitted to the driver 42 and the fastener being driven. When the energy transfer member 38 comes into contact with the resilient bumper 39, the resilient bumper 39 will begin to absorb energy from the energy transfer member. This is done so as to rapidly decelerate the energy transfer member 38 and condition it for reversal so that another drive cycle can be initiated. This process is continued until the fastener has been fully driven. When the fastener has been fully driven into the workpiee, the magazine 4 will abut at least one abutment surface within the tool body 2. For example, the peg-like followers could abut the ends of their respective guide channels. With further shifting of magazine 4 precluded, additional downward pressure on the tool by the operator will not cause the energy transfer member 38 to shift into the path of the rotating impact member 26b. Thus, even though the impact member 26b continues to rotate, no further reciprocation of the energy transfer member 38 or driver 42 occurs.

When the tool is lifted from the workpiece, the magazine 4 will return to its normal extended position illustrated in FIGS. 1 and 2, the driver 42 will remain adjacent the energy transfer member 38, and the energy transfer member 38 will return to its normal position against resilient bumper 39 and away from impact member 26b, by virtue of spring 41. Everything is now in position for the driver to drive the next succeeding fastener within the magazine 4, upon application of pressure to the tool 1 against the workpiece by the operator.

In the embodiment shown in FIGS. 1 and 2, the impact member 26b is illustrated as having a single impacting surface 26d. Thus, during the fastener driving operation, the energy transfer member 38 will be impacted by the impacting surface 26c, once for every revolution of the impact member 26b. It will be understood by one skilled in the art that additional impacting surfaces could be provided on impact member 26b such as impacting surface 26d shown in broken lines. In this instance, the energy transfer member 38 will be impacted (during a fastener driving operation) a number of times per revolution of impact member 26b equal to the member of impacting surfaces provided thereon. The rapidity with which the fastener is driven into the workpiece will depend in part at least on the pressure applied to the tool against the workpiece by the operator.

The tool just described translates rotary motion into reciprocating motion, producing relatively short (0.020–0.150 inch) high velocity drive strokes in rapid succession. It will be noted from FIG. 2 that the coaxial long axes of driver 42 and energy transfer member 38 are not coplanar with the axis of shaft 19, the driver 42 and energy transfer member 38 being located slightly to one side of shaft 19 (i.e. slightly to the right as viewed in FIG. 2). The impact member 26b rotates in the direction of arrow A. It has been found that by locating the driver 42 and energy transfer member 38 in the positions shown in FIG. 2, the downward force vector imparted to the energy transfer member 38 by impacting surface 26c is better optimized.

Figure 3:
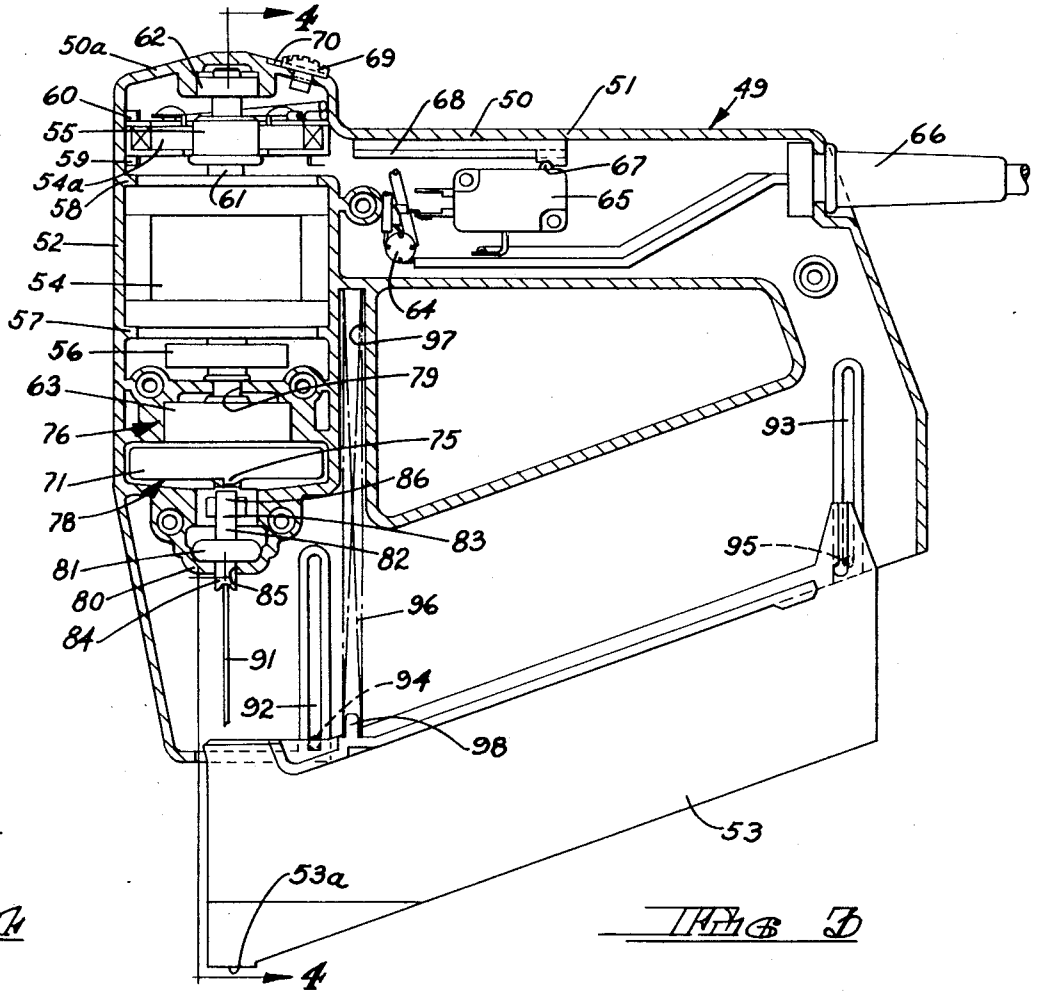
FIG. 3 is an elevational view, partly in cross section, of a second embodiment of the tool of the present invention.
Figure 4:
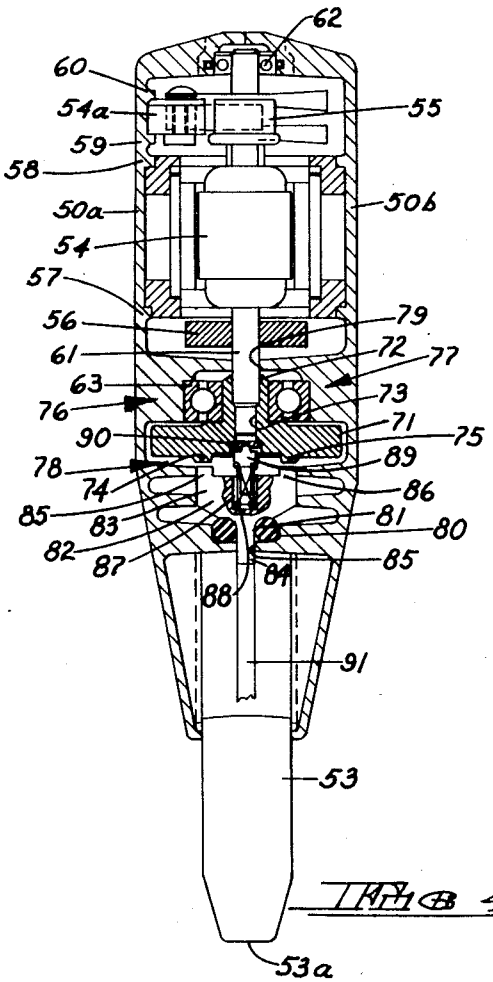
FIG. 4 is a cross-sectional view taken along section line 4—4 of FIG. 3.

A second embodiment of the present invention is illustrated in FIGS. 3 and 4, wherein like parts have again been given like index numerals. The tool of this embodiment is generally indicated at 49. As in the case of the embodiment of FIGS. 1 and 2, the tool 49 comprises a body 50 having a handle portion 51, a main body portion 52 and a fastener-containing magazine 53. The body 50 is made up of two halves 50a and 50b which are substantial mirror images of each other. Again, while the bodies may be cast of metal or the like, it is preferred that they be molded of a tough, durable plastic material.

The embodiment of FIGS. 3 and 4 differs from the embodiment of FIGS. 1 and 2 primarily in that the entire drive mechanism is in an in-line, vertical arrangement, as viewed in FIGS. 3 and 4. The principle of operation is identical.

To this end, the embodiment of FIGS. 3 and 4 is illustrated as having a prime mover in the form of a DC motor 54, having a brush assembly 54a, a commutator 55 and a fan 56. As in the case of the embodiment of FIGS. 1 and 2, the only requirement is that the prime mover provide rotary motion. The prime mover could be of any appropriate type, such as those listed in the description of the embodiment of FIGS. 1 and 2. The motor 54 is received within integral ribs 57 and 58 on the inside surface of body half 50*a*. It will be understood that body half 50*b* will have integral interior ribs corresponding to ribs 57 and 58. The commutator and brush assembly is supported between integral interior ribs 59 and 60 on body half 50*a*. The motor shaft 61 is supported at its uppermost end in bearing 62. Similarly, the motor shaft 61, near its lower end, is supported by bearing 63.

Since prime mover 54, for purposes of an exemplary showing, is described as a DC motor, it is connected through a rectifier 64 and an on-off switch 65 to a conventional cord set 66, by means of which it can be connected to a conventional source of 115 volt AC current. The on-off switch 65 is provided with a conventional actuator 67 engaged by an elongated member 68, slidably mounted with body 50. The member 68 is operatively connected to the manual switch actuator 69 located in the depression 70 in body 50. Thus, when the manual switch actuator 69 is shifted to its on position, the actuator 67 of switch 65 will be shifted to its on position. Similarly, when the manual actuator 69 is shifted to its off position, switch actuator 67 will be shifted to its off position.

An integral, one-piece flywheel/impact member is shown at 71, non-rotatively affixed to the lower end of motor shaft 61. The flywheel/impact member 71 has a portion 72 of reduced diameter, received within bearing 63. The flywheel/impact member 71 has an axial bore 73, non-rotatively receiving the lower end of motor shaft 61 (see FIG. 4). The bottom surface of flywheel-/impact member 71 is provided with a pair of diametrically opposed, identical impacting surfaces 74 and 75.

Body half 50*a* has a wall structure (constituting an integral, one-piece part of body half 50*a*) formed on its interior surface and generally indicated at 76. The body half 50*b* has a substantially identical interior wall structure generally indicated at 77 and comprising substantially a mirror image of wall structure 76. When the body halves 50*a* and 50*b* are joined together, the wall structures 76 and 77 define a chamber, generally indicated at 78. The motor shaft 61 passes through a perforation 79 at the upper end of chamber 78. The bearing 63 is supported within the chamber 78 and the chamber surrounds the flywheel/impact member 71. The lower end of chamber 78 is provided with an annular seat 80 supporting an annular resilient bumper 81.

An energy transfer member is shown at 82. The energy transfer member has an enlarged head portion 83 located within chamber 78, beneath the flywheel/impact member 71. The energy transfer member 82 has a stem or shaft-like portion 84 which passes through the resilient bumper 81 and an opening 85 at the bottom of chamber 78. The enlarged head portion 83 of the impact member has a pair of upstanding lugs 85 and 86 adapted to cooperate with impacting surfaces 74 and 75. The energy transfer member head portion 83 has a central bore 87 adapted to receive a spring 88. The lower end of spring 88 abuts the bottom of bore 87. At its upper end, the spring 88 is provided with a spring guide 89. The spring guide serves as a seat for the upper end of spring 88 and has a nose portion abutting a thrust bearing 90 located in the axial bore 73 of the flywheel/impact member 71. It will be apparent from FIG. 4, for example, that spring 88 will bias the energy transfer member 82 against resilient bumper 81 and out of contact with flywheel/impact member 71 and its impacting surfaces 74 and 75.

The drive train is completed by a driver 91. The driver 91 has a upper end contactable by the lower end of the stem portion 84 of energy transfer member 82. The driver 91 can be an integral, one-piece part of the energy transfer member stem portion 84, or it can be a separate element as described with respect to driver 42 of FIGS. 1 and 2 and supported adjacent stem portion 84 by a resilient means (not shown) similar to resilient member 42*a* of FIG. 1. The lower end (not shown) of driver 91 extends into magazine 53 above the forwardmost fastener (not shown) located therein.

Magazine 53 may be substantially identical to the magazine 4 of FIGS. 1 and 2 (containing a row of fasteners, not shown, and means, not shown, to advance each fastener, in its turn, to a forwardmost position to be driven) and is provided with a nose portion 53*a*. As is true of magazine 4 of FIGS. 1 and 2, the magazine 53 must be capable of shifting between a normal extended position illustrated in FIGS. 3 and 4 and a retracted position within the body 50. To this end, the body half 50*a* is provided with elongated guide channels 92 and 93, equivalent to the guide channels 43 and 44 of FIG. 1. It will be understood that the body half 50*b* will be provided with cooperating guide channels (not shown). The magazine 53 is provided with a peg-like follower 94 located in guide channel 92 and a peg-like follower 95 located in guide channel 93. The magazine 53 will be provided with similar peg-like followers (not shown) located in the guide channels in body half 50*b*.

The operation of the embodiment of FIGS. 3 and 4 is substantially identical to the operation of the embodiment of FIGS. 1 and 2. The operator of tool 49 first shifts the manual switch actuator 69 to its on position. This will cause the actuator 67 of switch 65 to shift to its on position, energizing motor 54. As a result of this, the flywheel/impact member 71 will rotate at a relatively high RPM (15,000–30,000 RPM). The flywheel portion of the flywheel/impact member 71 will store energy from motor shaft 61 and will transfer that energy to the impact member portion of the element 71.

Since spring 88 normally maintains the energy transfer member 82 against resilient bumper 81 and out of contact with the impacting surfaces 74 and 75, no impact occurs until the operator locates the nose 53*a* of magazine 53 against the workpiece into which the fasteners are to be driven and presses the tool thereagainst. The magazine 53 will tend, under pressure, to shift toward its retracted position within body 50. Since driver 91 overlies the frontmost fastener within magazine 53, the shifting of the magazine will cause, through driver 91, a shifting of the energy transfer member 82 into the rotating path of impacting surfaces 74 and 75. These impacting surfaces 74 and 75 are designed to transmit an impact to the energy transfer member 82, causing the energy transfer member 82 to be forcibly accelerated away from the flywheel/impact member 71 at a substantial velocity. Energy from the energy transfer member 82 is transferred to driver 91 (producing high velocity, short strokes of from about 0.020 to about 0.150 inch) and, in this way, the fastener is driven.

As in the case of the embodiment of FIGS. 1 and 2, the energy transfer member 82 is free to leave the impacting surfaces 74 and 75 when impacted by them. Initially, all of the energy in the energy transfer member 82 is used to drive the fastener. When the energy transfer member 82 contacts resilient bumper 81, the bumper will begin to absorb energy to rapidly decelerate the energy transfer member 82 and condition it for reversal, ready for another drive cycle to be initiated.

It will be noted that the flywheel/impact member 71 is provided with a pair of diametric impacting surfaces 74 and 75, while the energy transfer member 82 is provided with a pair of cooperating upstanding lugs 85 and 86. This design provides for symmetrical loading of the mechanism. This design produces two impact drive cycles per revolution of the flywheel/impact member 71. Additional pairs of impacting surfaces could be provided on the flywheel/impact member 71 to increase the number of impact drive cycles per revolution of the flywheel/impact member 71.

As in the case of the embodiment of FIGS. 1 and 2, the fastener will be driven at a rate depending in part at least on the amount of pressure applied to tool 49 by the operator. When the fastener has been fully driven, the energy transfer member 71 will automatically shift away from impacting surfaces 74 and 75, because further shifting of magazine 53 will be precluded by abutment of magazine 53 against one or more abutment surfaces within body 50 in the same manner described with respect to magazine 4.

Finally, as in the case of the magazine 4 of the embodiment of FIGS. 1 and 2, means are provided in the embodiment of FIGS. 3 and 4 to bias magazine 53 to its normal extended position shown in FIGS. 3 and 4. This means comprises a compression spring 96. The upper end of compression spring 97 is located in a socket or bore 97 in the body 50 and abuts the upper end of the bore 97. The lower end of compression spring 96 abuts the magazine 53 about the upstanding lug 98.

Modifications may be made in the invention without departing from the spirit of it. As used herein and in the claims, such terms as "forward", "rearward", "top", "bottom", "upwardly", "downwardly" are employed in view of the Figures for purposes of clarity. When in use, the tool of the present invention can assume any required position.

What is claimed is:

1. A fastener driving tool for driving a fastener into a workpiece, said tool comprising a shaft rotatable about its axis, a prime mover to impart rotary motion to said shaft, a fastener driver in association with said tool and means to translate said rotary motion of said shaft into reciprocating motion of said driver, constituting a series of short, high-velocity strokes in rapid succession, by imparting discrete blows to said driver in rapid succession, said translation means comprising an impact member non-rotatively mounted with respect to said shaft and having at least one impacting surface thereon, an energy transfer member having a first end adapted to cooperate with said at least one impacting surface of said impact member and a second end adapted to cooperate with said driver, said energy transfer member being shiftable between a first position wherein said first end is spaced from said at least one impacting surface of said impact member, and a second position wherein said first end is impacted by said at least one impacting surface of said impact member in raid succession, a means to normally bias said energy transfer member to said first position, and a resilient energy absorbing member disposed to arrest said energy transfer member at the termination of each of said short, high-velocity strokes.

2. The structure claimed in claim 1, wherein said driver is positioned to contact said second end of said energy transfer member and to shift said energy transfer member to said second position when said tool is moved against said workpiece, causing said energy transfer member to be impacted by said at least one impacting surface of said impacting member in rapid succession to generate short high-velocity strokes of said driver.

3. The structure claimed in claim 1, wherein said driver comprises an integral one-piece part of said energy transfer member.

4. The structure claimed in claim 1, wherein said tool has a body with a handle portion and a magazine, said magazine containing a plurality of fasteners and being shiftable with respect to said body in a direction parallel to the axis of said driver between a normal extended position substantially outside said body and a retracted position substantially within said body, and means to bias said magazine to said normal extended position, said magazine having a nose portion engageable with said workpiece during a fastener driving operation and through which the fastener is driven, whereby said magazuine shifts from said normal extended position to said retracted position during a fastener driving operation when said tool is urged against said workpiece.

5. The structure claimed in claim 1, wherein said shaft comprises the shaft of said prime mover.

6. The structure claimed in claim 1, wherein said shaft is connected to the shaft of said prime mover by a flexible drive link.

7. The structure claimed in claim 1, wherein said prime mover is chosen from the class consisting of an air motor, a hydraulic motor, an electric motor and an internal combustion motor.

8. The structure claimed in claim 1, wherein said energy transfer member contains an intermediate shoulder positioned between said first and second ends.

9. The structure claimed in claim 8 wherein said shoulder of said energy transfer member abuts said energy absorbing member when said energy transfer member is in its first position.

10. The structure claimed in claim 1 wherein said translation means further comprises a flywheel non-rotatively affixed to said shaft for storing energy generated by said rotary motion.

11. The structure claimed in claim 10, wherein said impact member is attached to said flywheel.

12. The structure claimed in claim 10, wherein said impact member and said flywheel comprise an integral one-piece structure.

13. The structure claimed in claim 1, wherein the axis of said shaft is perpendicular to the long axis of said energy transfer member, said at least one impacting surface on said impact member being located on its peripheral edge.

14. The struture claimed in claim 13, including more than one impacting surface on said peripheral edge of said impact member.

15. The structure claimed in claim 13, wherein the axis of said shaft and the axis of said energy transfer member are non-coplanar.

16. The structure claimed in claim 1, wherein the axis of said shaft is parallel with the long axis of said energy transfer member, said at least one impacting surface of said impact member being located on that face thereof adjacent said first end of said energy transfer member.

17. The structure claimed in claim 16, wherein said first end of said energy transfer member has more than one surface contactable by said at least one impacting surface of said impact member.

18. The structure claimed in claim 16, including more than one impacting surface on said face of said impact member.

19. The structure claimed in claim 18, wherein said first end of said energy transfer member has more than one surfae contactable by said impacting surfaces of said impact member.

* * * * *